US007802860B2

(12) United States Patent
Mizuno

(10) Patent No.: US 7,802,860 B2
(45) Date of Patent: Sep. 28, 2010

(54) LIQUID EJECTING APPARATUS AND METHOD FOR DETERMINING LIQUID DEPLETION TO MAINTAIN A PRESSURE DIFFERENTIAL BETWEEN AN INK JET HEAD AND INK CARTRIDGE

(75) Inventor: Hidekazu Mizuno, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 360 days.

(21) Appl. No.: 11/724,122

(22) Filed: Mar. 13, 2007

(65) Prior Publication Data

US 2007/0211089 A1 Sep. 13, 2007

(30) Foreign Application Priority Data

Mar. 13, 2006 (JP) ..... 2006-067727

(51) Int. Cl.
*B41J 2/195* (2006.01)
*B41J 29/38* (2006.01)
*B41J 29/393* (2006.01)

(52) U.S. Cl. ..... 347/7; 347/6; 347/19

(58) Field of Classification Search ..... 347/7
See application file for complete search history.

(56) References Cited

U.S. PATENT DOCUMENTS 6,007,173 A * 12/1999 DeLouise et al. ..... 347/7
6,962,399 B2 * 11/2005 Anderson et al. ..... 347/7
6,966,222 B2 * 11/2005 Carlson et al. ..... 347/7
2002/0097283 A1 * 7/2002 Askren et al. ..... 347/7
2004/0012648 A1 * 1/2004 Mizoguchi et al. ..... 347/19

FOREIGN PATENT DOCUMENTS

| | | |
|---|---|---|
| JP | 62-092850 | 4/1987 |
| JP | 05-338194 A | 12/1993 |
| JP | 09-094981 | 4/1997 |
| JP | 09-254405 | 9/1997 |
| JP | 11-078065 | 3/1999 |
| JP | 11-192724 | 7/1999 |
| JP | 2000-246919 | 9/2000 |
| JP | 2000-334938 A | 12/2000 |
| JP | 2004-299341 | 10/2004 |

* cited by examiner

*Primary Examiner*—Matthew Luu
*Assistant Examiner*—Shelby Fidler
(74) *Attorney, Agent, or Firm*—Nutter McClennen & Fish LLP; John J. Penny, V

(57) ABSTRACT

A liquid-ejecting apparatus includes a liquid-ejecting section that ejects a liquid onto an object, a liquid container containing the liquid and detachably attached to the liquid-ejecting section, and a depletion-determining section. The liquid container supplies a predetermined amount of liquid to the liquid-ejecting section by a pressure corresponding to the amount of ink remaining in the liquid container. The depletion-determining section determines depletion of the liquid if the amount of ink remaining falls below a threshold depending on temperature.

4 Claims, 4 Drawing Sheets

| AMBIENT TEMPERATURE | THRESHOLD |
|---|---|
| 10°C | 3.50 g |
| ≤ 15°C | 2.80 g |
| ≤ 20°C | 2.50 g |
| ≤ 25°C | 2.00 g |
| ≤ 30°C | 1.50 g |
| ≤ 35°C | 1.20 g |

| AMBIENT TEMPERATURE | THRESHOLD |
|---|---|
| 10°C | 3.50 g |
| ≤ 15°C | 2.80 g |
| ≤ 20°C | 2.50 g |
| ≤ 25°C | 2.00 g |
| ≤ 30°C | 1.50 g |
| ≤ 35°C | 1.20 g |

| TIME | AMBIENT TEMPERATURE |
|---|---|
| t1 | 18°C |
| t2 | 16°C |
| t3 | 20°C |
| t4 | 24°C |
| t5 | 22°C |
| t6 | 28°C |

LIQUID EJECTING APPARATUS AND METHOD FOR DETERMINING LIQUID DEPLETION TO MAINTAIN A PRESSURE DIFFERENTIAL BETWEEN AN INK JET HEAD AND INK CARTRIDGE

BACKGROUND

This application is based on Japanese Patent Application No. 2006-67727 filed on Mar. 13, 2006, in Japanese Patent Office, the entire content of which is hereby incorporated by reference.

1. Technical Field

The present invention relates to liquid-ejecting apparatuses and methods for determining whether a liquid contained in a liquid container is depleted, and particularly to a liquid-ejecting apparatus and a method for determining depletion of a liquid with respect to a threshold of the amount of liquid remaining which depends on temperature.

2. Related Art

Liquid-ejecting apparatuses designed for ejecting various liquids onto an object are known. For example, JP-A-11-78065 discloses an ink jet printer including an ink jet head for ejecting ink droplets from nozzle openings onto a medium such as recording paper and an ink cartridge for supplying the ink to the ink jet head.

Such an ink jet printer requires a stable supply of ink from the ink cartridge to the ink jet head. In intermittent ejection of the ink from the ink jet head, the amount of ink equal to that consumed for each ejection operation must be supplied from the ink cartridge to the ink jet head before the next ejection operation in synchronization with the ejection of the ink.

The ink is supplied from the ink cartridge to the ink jet head by an internal pressure difference between the ink jet head and the ink cartridge. The head pressure of the ink contained in the ink cartridge tends to push the ink into the ink jet head through a channel provided therebetween. The head pressure is maintained within such a range as not to excessively supply the ink to the ink jet head. The pressure in the ink jet head, on the other hand, decreases after ejection of the ink. The ink flows from the ink cartridge into the ink jet head if the pressure in the ink jet head falls below the pressure in the ink cartridge.

The head pressure pushing the ink from the ink cartridge into the ink jet head decreases as the ink is consumed and the amount of ink remaining in the ink cartridge decreases accordingly. The ink is no longer supplied if the decreased pressure in the ink jet head does not fall below that in the ink cartridge to a certain extent.

Some known ink jet printers prevent defective ink supply using a threshold of the amount of ink remaining at which ink supply is terminated. If the amount of ink remaining falls below the threshold, the printers determine that the ink is depleted and, for example, advise users to replace the cartridge even though the ink remains therein.

General printing inks, however, exhibit a lower viscosity at a higher temperature and a higher viscosity at a lower temperature. Ink with increased viscosity experiences higher channel resistance and thus flows through the channel less easily. A certain level of pressure in the ink cartridge is thus required to supply such viscous ink to the ink jet head in time for ejection. Conversely, ink with decreased viscosity can be supplied in time for ejection even if the pressure in the ink cartridge is decreased to a certain extent.

In the known art described above, ink depletion is determined whenever the amount of ink remaining falls below a predetermined threshold, although the remaining ink can still be supplied if it has decreased viscosity. That is, ink depletion is determined even if the amount of ink remaining is at such a level that the ink can still be supplied after a temperature rise and the resulting decrease in viscosity. This wastes the remaining ink. On the other hand, no determination of ink depletion can be made even though the amount of ink remaining is at such a level that the ink can no longer be supplied after a temperature drop and the resulting increase in viscosity.

SUMMARY

An advantage of some aspects of the invention is that it provides a liquid-ejecting apparatus that can detect the optimum timing for determining depletion of ink (liquid) without wasting the ink and a method for determining the depletion of the ink.

A liquid-ejecting apparatus according to an aspect of the invention includes a liquid-ejecting section that ejects a liquid onto an object, a liquid container containing the liquid and detachably attached to the liquid-ejecting section, and a depletion-determining section. The liquid container supplies a predetermined amount of liquid to the liquid-ejecting section by a pressure corresponding to the amount of ink remaining in the liquid container. The depletion-determining section determines depletion of the liquid if the amount of ink remaining falls below a threshold depending on temperature.

The liquid-ejecting apparatus according to the aspect of the invention can use the maximum amount of liquid to avoid wastage thereof because the threshold of the amount of liquid remaining for determining the depletion of the liquid depends on temperature.

Preferably, the liquid has a first viscosity at a first temperature and a second viscosity lower than the first viscosity at a second temperature higher than the first temperature, and the depletion-determining section determines the depletion of the liquid with respect to a first threshold at the first temperature and with respect to a second threshold lower than the first threshold at the second temperature.

The liquid-ejecting apparatus determines depletion of a liquid that exhibits a higher viscosity at a lower temperature and a lower viscosity at a higher temperature, for example, printing ink, with respect to a lower threshold at a higher temperature and with respect to a higher threshold at a lower temperature. The liquid-ejecting apparatus can therefore use the maximum amount of liquid according to temperature to avoid wastage thereof.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the drawings, although the technical scope of the invention is not limited to these embodiments and includes the items described in the claims and equivalents thereof.

Figure 1:
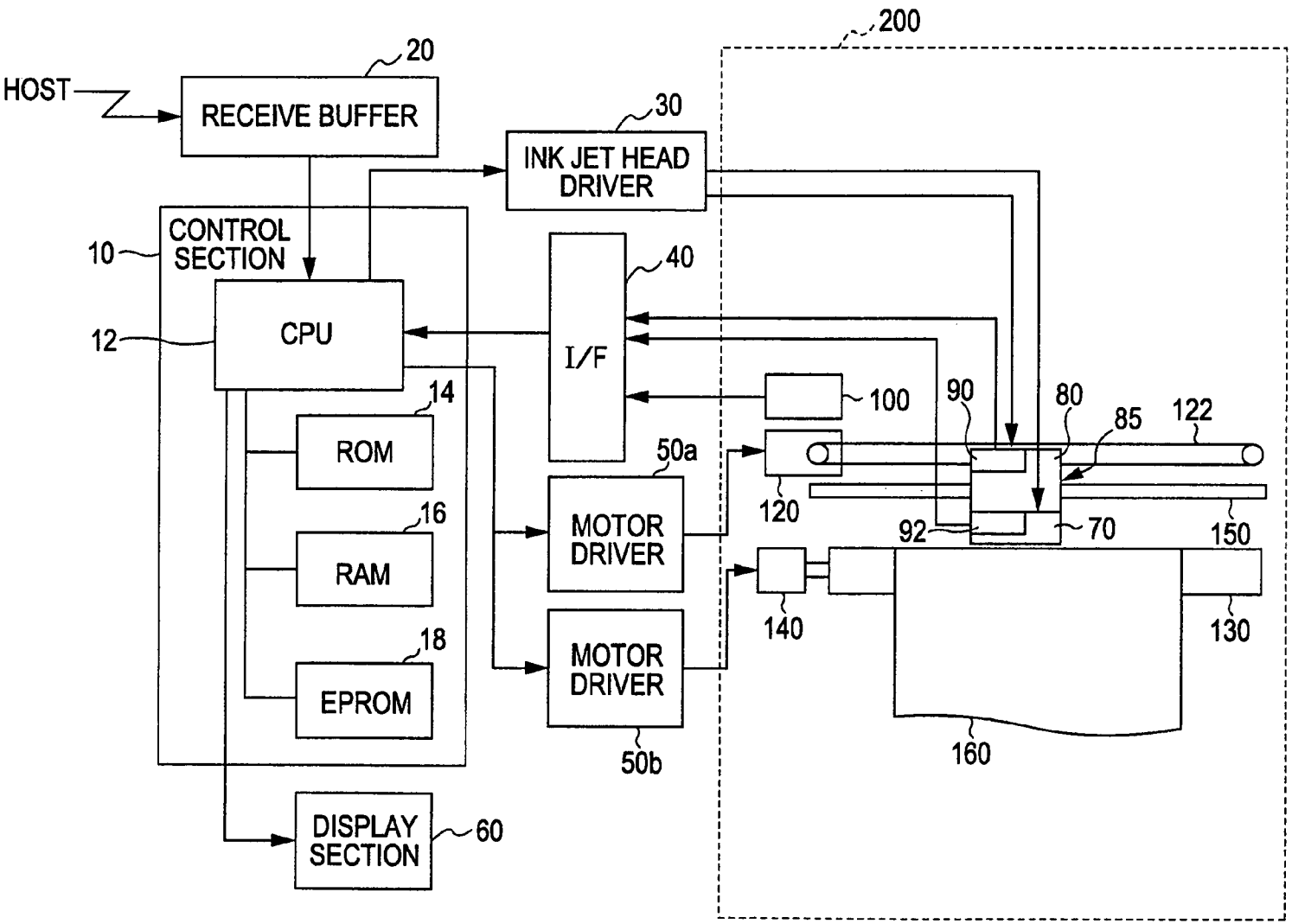
FIG. 1 is a block diagram of an ink jet printer taken as an example of a liquid-ejecting apparatus according to an embodiment of the invention.

FIG. 1 is a block diagram of an ink jet printer taken as an example of a liquid-ejecting apparatus according to an embodiment of the invention. This ink jet printer includes a control system including a control section 10, a receive buffer 20, an ink jet head driver 30, an interface 40, motor drivers 50*a* and 50*b*, and a display section 60. The ink jet printer further includes a printing section 200.

The printing section 200 includes an ink jet head 70, an ink cartridge 80, a carriage 85, an ink cartridge sensor 92, a temperature sensor 100, a carriage motor 120, a drive belt 122, a platen 130, a feed motor 140, and a sliding shaft 150.

The structure and operation of each section will be described. The control section 10 includes a CPU 12, a ROM 14, a RAM 16, and an EPROM 18 to control the other sections. The CPU 12 controls the other sections using the RAM 16 as an operating region according to a control program stored in the ROM 14. The EPROM 18 stores information on, for example, a history of ambient temperature sensed by the temperature sensor 100, thresholds for determining ink depletion, and the amount of ink remaining in the ink cartridge 80.

The control section 10 is connected to the receive buffer 20, which is supplied with print data from a host such as a personal computer. The control section 10 executes the series of operations described below according to the print data supplied to the receive buffer 20.

First, the control section 10 drives the feed motor 140 via the motor driver 50*b* to rotate the platen 130, thereby transporting a recording sheet 160.

The control section 10 also drives the carriage motor 120 via the motor driver 50*a* to rotate the drive belt 122. The carriage 85 then reciprocates with the ink cartridge 80 and the ink jet head 70 mounted thereon along the sliding shaft 150 perpendicularly to a direction in which the recording sheet 160 is transported.

The control section 10 also transmits drive signals to the ink jet head 70 via the ink jet head driver 30 at predetermined timings corresponding to dots of an image to be printed. The ink jet head 70 then ejects ink droplets from nozzle openings to print, for example, an image corresponding to the print data on the recording sheet 160 being transported.

The ink jet head driver 30 counts the number of drive signals transmitted to the ink jet head 70 to record the number of dots corresponding to the ink droplets ejected in printing in a dot count memory provided on the ink cartridge 80.

The ink cartridge sensor 92 and the temperature sensor 100 are connected to the control section 10 via the interface 40.

The ink cartridge sensor 92 determines that the ink cartridge 80 is attached to the ink jet head 70 by sensing electrical connection. The ink cartridge sensor 92 thus senses attachment of the ink cartridge 80 for replacement and notifies the control section 10 of the attachment.

The temperature sensor 100 includes, for example, a thermistor. The temperature sensor 100 senses ambient temperature, that is, the temperature of the environment where the ink jet printer is used, and notifies the control section 10 of the detected ambient temperature via the interface 40. The temperature sensor 100 is positioned so that it can measure the ambient temperature, which is used as an alternative parameter to ink temperature. To sense the ink temperature more directly, the temperature sensor 100 may be configured to sense the temperature around the ink cartridge 80 or the temperature of the ink contained in the ink cartridge 80.

In the configuration described above, the control section 10 receives a dot count for a print job from the dot count memory 90 via the interface 40 and multiplies the dot count by the unit amount of ink droplet to determine the amount of ink used in the job. The control section 10 then subtracts the amount of ink used from the amount of ink remaining in the ink cartridge 80 before the print job, which is recorded in the EPROM 18, to determine the amount of ink remaining after the print job.

Changes in the amount of ink remaining in the ink cartridge 80 may also be directly sensed using, for example, an optical sensor or a weight sensor.

The control section 10 determines ink depletion if the detected amount of ink remaining falls below a threshold stored in the EPROM 18, displaying a message advising replacement of the ink cartridge 80 on the display section 60. The EPROM 18 stores different thresholds for different ink viscosities, which depend on ambient temperature. The control section 10 determines ink depletion using a threshold corresponding to ambient temperature.

If the ambient temperature is unstable, the control section 10 can determine ink depletion using a typical ambient temperature obtained from ambient temperatures sensed by the temperature sensor 100 and regularly recorded on the EPROM 18 as a history.

With the configuration described above, the ink jet printer according to this embodiment determines ink depletion with respect to a threshold depending on ambient temperature. The ink jet printer can therefore use the maximum amount of ink contained in an ink cartridge even if the viscosity of the ink varies with the ambient temperature. This avoids wastage of ink when, for example, the cartridge is replaced.

Next, the relationship between the amount of ink remaining and thresholds for determining ink depletion will be described.

Figure 2A:
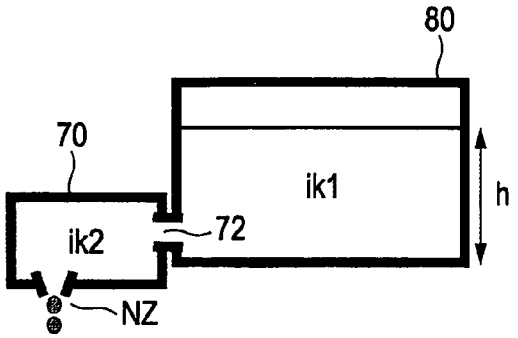
FIGS. 2A and 2B are diagrams illustrating a method for supplying ink from an ink cartridge to an ink jet head.
Figure 2B:
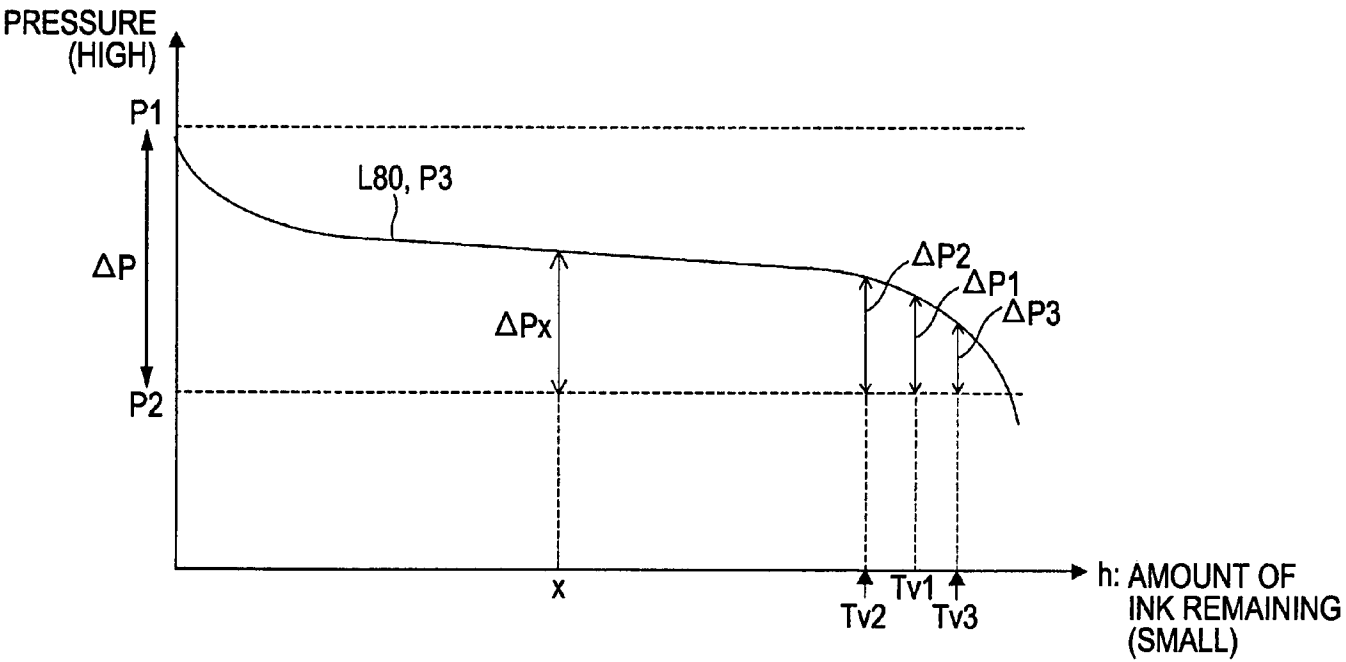

FIGS. 2A and 2B are diagrams illustrating a method for supplying ink from the ink cartridge 80 to the ink jet head 70. In FIG. 2A, the ink cartridge 80 is attached to the ink jet head 70, which communicates with the ink cartridge 80 through a channel 72.

The ink cartridge 80 contains an ink ik1. A head pressure depending on the amount of ink remaining, h, acts on the ink ik1. The head pressure tends to push the ink ik1 into the ink jet head 70 through the channel 72. The head pressure is maintained within a predetermined range so as not to excessively supply the ink ik1 to the ink jet head 70 or cause, for example, ink leakage. For example, a predetermined negative pressure is induced using an absorber such as foam (not shown) or by the restoring force of an ink pack to return the ink into the ink cartridge 80.

A piezoelectric element or a heating element (not shown) applies pressure to an ink ik2 stored in the ink jet head 70 to eject ink droplets from a nozzle opening NZ. As the ink ik2 is ejected, the pressure in the ink jet head 70 decreases, causing a pressure difference between the ink jet head 70 and the ink cartridge 80. The pressure difference forces the ink ik1 to flow from the ink cartridge 80 into the ink jet head 70 through the channel 72.

FIG. 2B is a graph showing the relationship between the pressures in the ink jet head 70 and the ink cartridge 80 shown in FIG. 2A. In this graph, the pressures in the ink jet head 70 and the ink cartridge 80 are plotted against the amount of ink remaining in the ink cartridge 80.

A curve L80 indicating the pressure in the ink cartridge 80 shows that a pressure P3 tending to push the ink ik1 into the ink jet head 70 decreases as the head pressure decreases with decreasing amount of ink remaining under the effect of the negative pressure. According to the graph, additionally, the pressure in the ink jet head 70 decreases after ink ejection by a difference ΔP between a pressure P1 after ink charging and a pressure P2 decreased after ink ejection.

If the pressure P3 in the ink cartridge 80 ranges between the pressures P1 and P2 (the amount of ink remaining=x), the ink ik1 is supplied to the ink jet head 70 by a pressure difference ΔPx between the pressure P3 in the ink cartridge 80 and the decreased pressure P2 in the ink jet head 70. The pressure difference ΔPx must be maintained at a predetermined level or higher to supply the ink ik1 from the ink cartridge 80 to the ink jet head 70 in time for ejection.

If the amount of ink remaining is Tv1, the pressure difference ΔP1 between the pressure P3 in the ink cartridge 80 and the pressure P2 in the ink jet head 70 falls below the level required to supply the ink ik1 in time for ejection of the ink from the ink jet head 70. In that case, the ink cartridge 80 can no longer stably supply the ink ik1 to the ink jet head 70; therefore, Tv1 is defined as a threshold for determining ink depletion.

The threshold of the amount of ink remaining in the ink cartridge 80 for determining ink depletion is thus defined, although the optimum threshold depends on the viscosity of the ink ik1. In terms of ink viscosity, which varies with temperature, different thresholds for determining ink depletion are used according to temperature as described below.

Figures 3, 4A, 4B:
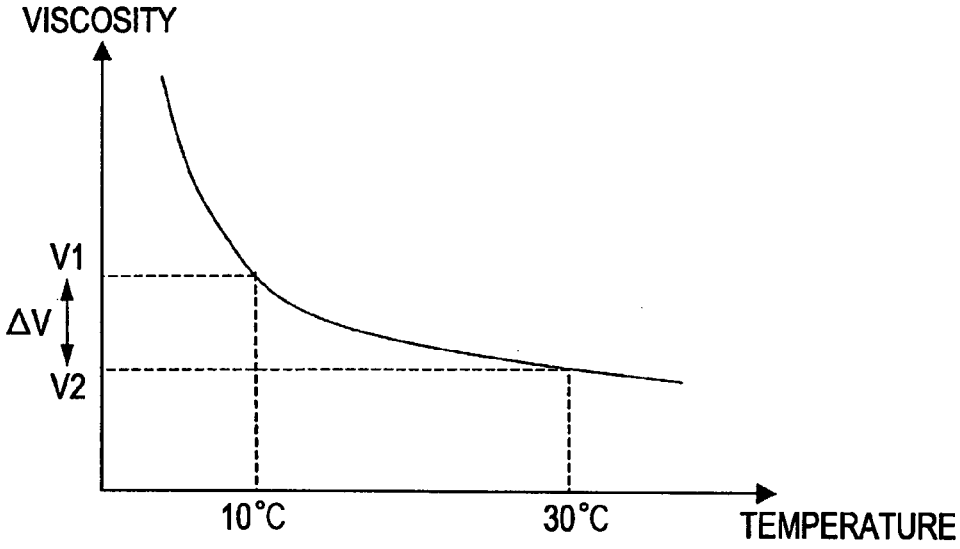
FIG. 3 is a graph showing variations in temperature and ink viscosity.
FIGS. 4A and 4B are tables showing correspondence between ambient temperatures and thresholds of the amount of ink remaining for determining ink depletion.

FIG. 3 is a graph showing variations in temperature and ink viscosity. In this graph, ink viscosity is plotted against ink temperature. According to the graph, ink viscosity decreases with increasing temperature. For example, there is a difference ΔV between ink viscosity V1 at 10° C. and ink viscosity V2 at 30° C. The ink at 10° C. can flow through the channel 72 less easily than the ink at 30° C., thus requiring a higher pressure for supply to the ink jet head 70.

The above relationship is shown in FIG. 2B. At 10° C., the ink ik1 requires at least a pressure difference ΔP2 between the pressures P3 and P2 corresponding to the viscosity V1 so that the ink ik1 can be supplied in time for ejection from the ink jet head 70. The amount of remaining ink required to provide the pressure difference ΔP2 is Tv2, which is defined as a threshold for determining ink depletion at 10° C.

On the other hand, a pressure difference ΔP3 corresponding to the viscosity V2, which is lower than the viscosity V1, is required at 30° C. The pressure difference ΔP3 required at 30° C. is therefore smaller than the pressure difference ΔP2 required at 10° C. Accordingly, the amount of remaining ink required to provide the pressure difference ΔP3 is smaller than Tv2, namely, Tv3, which is defined as a threshold for determining ink depletion at 30° C.

As described above, the optimum threshold of the amount of ink remaining for determining ink depletion depends on ink viscosity, which varies with temperature. In this embodiment, accordingly, ink depletion is determined using the optimum threshold selected from thresholds corresponding to different ink temperatures. This method avoids wastage of usable ink at high temperature and allows determination of ink depletion before causing defective ink supply at low temperature.

In this embodiment, ambient temperature, which is the temperature of the environment where the ink jet printer is used, is used as an alternative parameter to ink temperature to define a threshold of the amount of ink remaining because ink temperature varies with ambient temperature.

FIGS. 4A and 4B show correspondence between ambient temperatures and thresholds of the amount of ink remaining for determining ink depletion. FIG. 4A is a table showing the correspondence between ambient temperatures and thresholds of the amount of ink remaining for determining ink depletion. As ink temperature increases with increasing ambient temperature, the viscosity of the ink ik1 decreases and the ink ik1 tends to flow more easily. Accordingly, the pressure required to supply the ink ik1 to the ink jet head 70 can be achieved with a smaller amount of ink remaining in the ink cartridge 80. Thus, the threshold used for determining ink depletion decreases with increasing ambient temperature.

The ink jet printer according to this embodiment stores a table as shown in FIG. 4A in the EPROM 18. The control section 10 retrieves a threshold corresponding to an ambient temperature sensed by the temperature sensor 100 from the table to determine ink depletion with respect to the threshold.

The method used for defining a threshold of the amount of ink remaining according to ambient temperature is not limited to the use of a table as shown in FIG. 4A. For example, the threshold may be defined by predetermined calculations, or using ink temperature as a parameter if the temperature sensor 100 is configured to directly sense the temperature of the ink ik1 in the ink cartridge 80.

Alternatively, the threshold of the amount of ink remaining may be defined according to a typical ambient temperature obtained from a recorded history of ambient temperature as shown in FIG. 4B. FIG. 4B shows a recorded history of ambient temperature sensed after the passage of times t1 to t6. According to FIG. 4B, ambient temperature increases rapidly in the period from the time t5 to the time t6. In this case, the threshold corresponding to 28° C. should not be selected because ink temperature normally does not increase as rapidly as ambient temperature. Instead, for example, the threshold corresponding to the median of the ambient temperatures sensed within the period from the time t1 to the time t6, namely, 21° C., may be selected at time t6.

As described above, ink temperature does not necessarily increase as rapidly as ambient temperature when ambient temperature varies unstably. The determination results optimum for viscosity corresponding to actual ink temperature may be difficult to achieve by defining a threshold of the amount of ink remaining according to varying ambient temperature. A threshold more suitable for viscosity corresponding to actual ink temperature can be defined using, for example, an average or median of ambient temperatures measured over a predetermined period of time as a typical ambient temperature.

Figure 5:
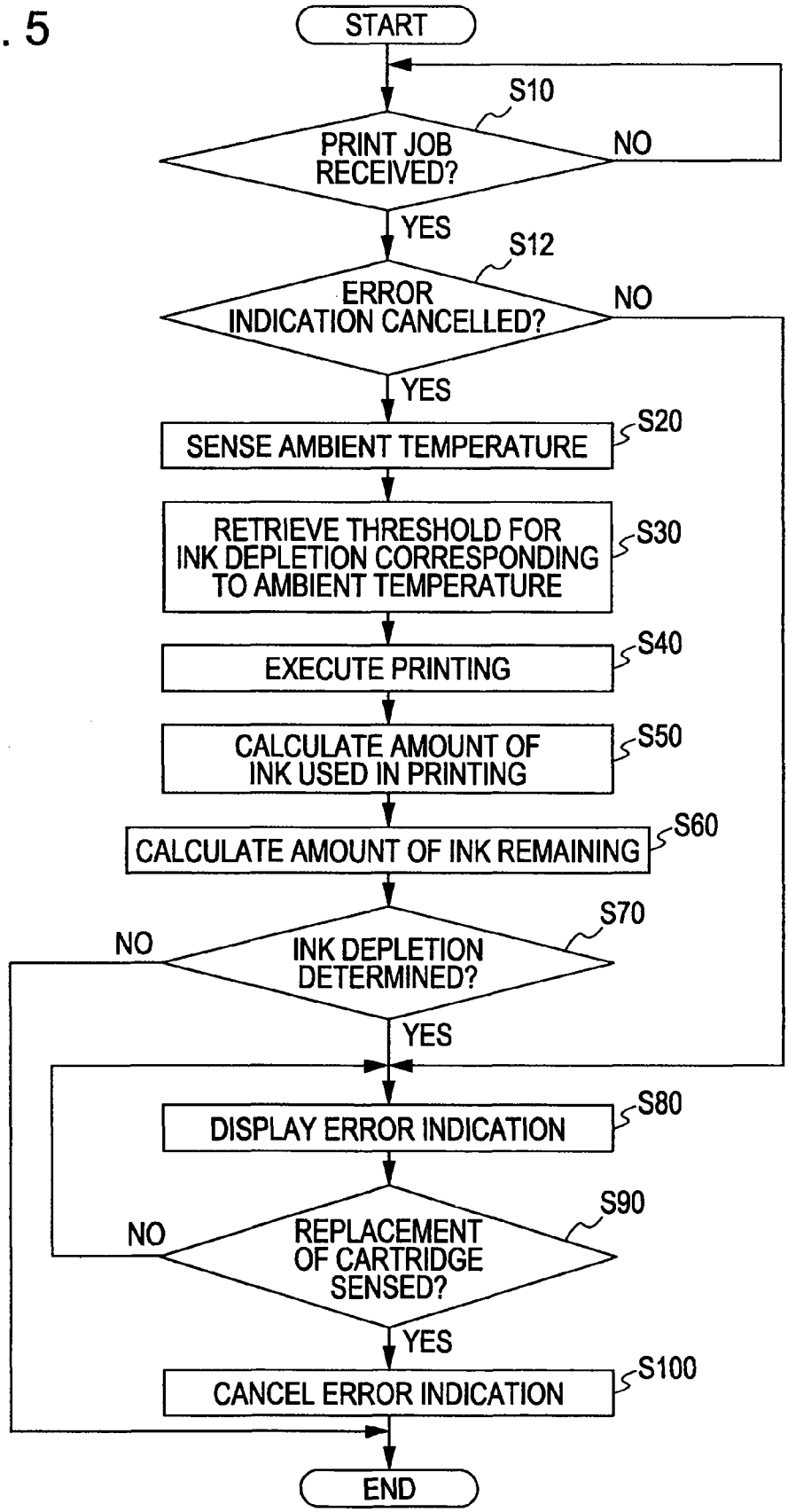
FIG. 5 is a flowchart showing a procedure of control operation of the ink jet printer according to this embodiment.

FIG. 5 is a flowchart showing a procedure of operation of the ink jet printer according to this embodiment. First, the control section 10 receives a print job via the receive buffer 20 (YES at Step S10) and determines whether an error indication advising replacement of the ink cartridge 80 is cancelled (Step S12). If the error indication is cancelled (YES at Step S12), the control section 10 acquires an ambient temperature sensed by the temperature sensor 100 (S20) and retrieves a threshold of the amount of ink remaining which corresponds to the ambient temperature from the table stored in the EPROM 18, as shown in FIG. 4A (Step S30).

Next, the control section 10 executes printing by driving the printing section 200 (Step S40), calculates the amount of ink used in the printing (Step S50), and calculates the amount of ink remaining in the ink cartridge 80 by subtracting the amount of ink used from the amount of remaining ink recorded in the EPROM 18 (Step S60).

After the calculation of the amount of ink remaining, the control section 10 compares it with the retrieved threshold to determine whether the ink is depleted (Step S70). If the amount of ink remaining falls below the threshold, the control section 10 determines that the ink is depleted (YES at Step S70) and causes the display section 60 to display an error indication advising replacement of the ink cartridge 80 (Step S80). If the ink cartridge sensor 92 senses replacement of the ink cartridge 80 (YES at Step S90), the control section 10 cancels the error indication (Step S100) and completes the print job.

The above procedure may be configured such that the determination of the control section 10 is maintained despite a further temperature change until the ink cartridge 80 is replaced. If, for example, the amount of ink remaining is 2.20 g at an ambient temperature of 20° C., the control section 10 determines that the ink is depleted because the amount of ink remaining falls below the threshold corresponding to 20° C., that is, 2.50 g (see FIG. 4A). The determination can be maintained even if the ambient temperature rises to 25° C. after the determination and the amount of ink remaining exceeds the threshold corresponding to 25° C., that is, 2.00 g (see FIG. 4A). Such a procedure can prevent users from being confused by frequent changes of determination.

The procedure may also be configured such that the control section 10 executes redetermination with respect to a threshold corresponding to the changed ambient temperature if the ambient temperature remains constant over at least a predetermined period of time after the temperature change; in this case, frequent changes of determination are unlikely to occur. Such a procedure can avoid wastage of ink.

The above description of the ink jet printer may be applied to various liquid-ejecting apparatuses including a liquid-ejecting section that ejects liquid from a nozzle opening onto an object and a supply unit that supplies the liquid to the liquid-ejecting section. Examples of such liquid-ejecting apparatuses include those for ejecting a coloring material onto a color filter of a liquid crystal display and those for ejecting a solvent used in the etching of a printed circuit board.

Such liquid-ejecting apparatuses can determine depletion of liquid at the optimum timing by changing a threshold of the amount of liquid remaining according to temperature. The liquid-ejecting apparatuses can therefore use the maximum amount of liquid to avoid wastage thereof. The liquid-ejecting apparatuses can also use a higher threshold at a higher temperature if the liquid used exhibits a higher viscosity at a higher temperature.

In addition, the threshold for determining depletion of liquid can be changed according to various conditions, such as humidity and atmospheric pressure, to use the maximum amount of liquid and thereby avoid wastage thereof under various conditions. Furthermore, the liquid-ejecting apparatuses can be configured so that users can select the threshold for determining depletion of liquid. In this case, for example, the users select any ambient temperature on a display screen showing printer drive settings, and the threshold is changed according to the settings.

As described above, the liquid-ejecting apparatuses according to this embodiment can determine depletion of liquid at the optimum timing by changing the threshold of the amount of liquid remaining according to temperature. The liquid-ejecting apparatuses can therefore use the maximum amount of liquid to avoid wastage thereof.

The liquid-ejecting apparatuses according to this embodiment can adopt both on-carriage type ink cartridge and off-carriage type ink cartridge.

An ink cartridge is arranged on a carriage for the on-carriage type ink cartridge. An ink cartridge is arranged in a printer body apart from a carriage and an ink jet head and an ink cartridge are connected by a tube and so on for the off-carriage type ink cartridge.

What is claimed is:

1. A liquid-ejecting apparatus comprising:

a liquid-ejecting section that ejects a liquid onto an object;

a liquid container containing the liquid, the liquid container supplying a predetermined amount of liquid to the liquid-ejecting section by a pressure corresponding to an amount of ink remaining in the liquid container; and a depletion-determining section that determines depletion of the liquid depending on temperature; wherein the liquid has a first viscosity at a first temperature and a second viscosity lower than the first viscosity at a second temperature higher then the first temperature;

the depletion-determining section defines an ink depletion threshold depending on temperature; and the amount of ink remaining in the reservoir is different depending on temperature when the depletion-determining section determines the ink depletion.

2. The liquid-ejecting apparatus according to claim 1, wherein the depletion-determining section maintains the determination of the depletion of the liquid even if the temperature changes after the determination.

3. The liquid-ejecting apparatus according to claim 1, wherein the depletion-determining section records a history of the temperature to determine the depletion of the liquid with respect to a typical temperature obtained from the history.

4. The liquid-ejecting apparatus according to claim 1, wherein a first ink depletion threshold is defined based on a first amount of ink remaining in the liquid container when the ink cannot be supplied by the pressure at the first temperature, and a second ink depletion threshold is defined based on a second amount of ink remaining in the liquid container when the ink cannot be supplied by the pressure at the second temperature.

* * * * *